US005444888A

United States Patent [19]

Withey

[11] Patent Number: 5,444,888

[45] Date of Patent: Aug. 29, 1995

[54] FOOT CLEANING APPARATUS

[76] Inventor: Edward L. Withey, 950 Andante Rd., Santa Barbara, Calif. 93105

[21] Appl. No.: 313,322

[22] Filed: Sep. 27, 1994

[51] Int. Cl.[6] ..... A47K 7/04

[52] U.S. Cl. ..... 15/114; 15/118; 15/160; 15/210.1

[58] Field of Search ..... 15/104.92, 106, 114, 15/118, 161, 160, 210.1

[56] References Cited

U.S. PATENT DOCUMENTS

| | | | |
|---|---|---|---|
| 605,552 | 6/1898 | Kinney . | |
| 3,451,092 | 6/1969 | Szopo | 15/106 |
| 3,531,814 | 10/1970 | Safalow . | |
| 3,939,825 | 2/1976 | Krummenacher . | |
| 4,489,448 | 12/1984 | Cairo . | |
| 4,532,668 | 8/1985 | Slonicki . | |
| 4,571,767 | 2/1986 | Dangler . | |
| 4,617,917 | 10/1986 | Miller . | |
| 4,961,733 | 10/1990 | Joseph et al. | 15/114 |
| 5,177,829 | 1/1993 | Simpson . | |

FOREIGN PATENT DOCUMENTS

| | | | |
|---|---|---|---|
| 11735 | 3/1934 | United Kingdom | 15/106 |
| 476186 | 12/1937 | United Kingdom | 15/106 |

*Primary Examiner*—Edward L. Roberts, Jr.
*Attorney, Agent, or Firm*—Harold L. Jackson

[57] ABSTRACT

A foot-and-toe cleaning apparatus that comprises an elongated shaft formed from a stiff plastic material which is provided with a cleaning assembly mounted adjacent the lower end of the shaft which includes a toe-cleaning device that includes a pair of spaced-apart support arm members extending outwardly from the shaft having a cleaning element supported therebetween and secured in place by a nut threadably mounted on each arm member. A brush is mounted on the shaft and positioned diametrically opposite from that of the toe-cleaning device for cleaning one's foot area including the ankle and lower portion of the legs.

12 Claims, 2 Drawing Sheets

FOOT CLEANING APPARATUS

BACKGROUND OF THE INVENTION

1. Field of the Invention

This invention relates generally to a device for cleaning the lower extremities of one's body and more particularly to a foot-cleaning apparatus, whereby the user thereof can maintain a substantially upright position during the cleaning of his or her feet, toes or lower portion of the legs without the need of bending over to do so.

2. Description of the Prior Art

There is a real need for a device to provide a suitable means for one to easily and safely clean and/or scrub the lower extremities of the body. This is especially true with regards to the elderly and infirm, those overweight or pregnant as well as people who have various medical conditions that make it difficult or prevent them from safely bending over, particularly in confined areas such as bathtubs or stall showers.

Many types of foot-cleaning devices have been tried and suggested. However, these devices have various limitations that restrict their use and are either specifically arranged for use as toe-cleaning devices, foot scrubbers or devices for applying various medicines. Moreover, some types of devices as mentioned above are complicated to operate, expensive to maintain and restricted to a particular use.

As example of some known cleaning devices one may refer to any of the following United States Patents.

There is disclosed in U.S. Pat. No. 3,531,814 to H. Safalow a toe-cleaning device that includes a conical-shaped toe cleaning member which is half brush and half sponge, and is mounted on a rod for insertion between adjacent toes.

In U.S. Pat. No. 3,939,825 to L. Krummenacher there is disclosed an apparatus for pedicure use which comprises a treatment chamber having an open top to allow at least one foot to be received in a device in which is operably mounted a foot-scrubbing means, a foot rest within the device, and a reciprocating means for foot-scrubbing action.

In U.S. Pat. No. 4,617,917 to G. C. Miller there is disclosed a foot-hygiene device that comprises a foundation member and a ventral brush supported by the foundation member for applying a scrubbing force to a ventral surface of the foot upon movement of the foot thereagainst.

In U.S. Pat. No. 4,961,733 to P. M. Joseph et al there is disclosed a foot cleaning and chemical application apparatus that comprises a handle, and a brush which is attached to the handle. The terminating end of the handle is adapted to removably receive a connector which supports absorbent sponge material having a size and shape to fit between the toes of a person for cleaning purposes.

In U.S. Pat. No. 4,520,525 there is disclosed an apparatus for brushing and cleaning feet which consists of an oblong receptacle having two compartments for the feet in which brush-like material is arranged to engage the toes of the feet.

In U.S. Pat. No. 4,532,668 there is disclosed a foot scrubber with a soap dispenser for users who cannot reach their feet, wherein the scrubber includes a handle connected to a vertical shaft having an arm for applying pressure on a compressible dispenser, only when the handle is in a predetermined angular position. Suction cups are also provided to hold the housing in place when the scrubber is in use.

SUMMARY AND OBJECTS OF THE INVENTION

It is an important object of the present invention to provide foot-cleaning apparatus that defines a bath aid to facilitate the washing of one's feet, toes and if necessary the lower portion of the legs in a very safe manner without having to stoop or bend over in stall showers or other similar confined areas.

Another object of the present invention is to provide a foot-cleaning apparatus that allows the elderly, and infirm, who by reason of back problems, arthritis or similar ailments find it difficult, if not impossible, to comfortably bend over to reach their lower extremities. People who are afflicted with such problems are often injured while trying to find a way to sit or kneel when there is no place to sit.

Still another object of the present invention is to provide a foot-cleaning apparatus of this character which includes an elongated shaft member having a gripping end on which is provided a suitable cap and a hanging cord. The opposite lower end of the shaft is formed having a pair of laterally extending, spaced-apart, threaded support arms mounted thereto so as to receive a securing nut. The distal threaded end of each arm is formed having an elongated opening or slot adapted to receive and support interchangeable scrubbing or cleaning elements such as a suitable cloth or brush. A selected cleaning element is arranged to be placed between the toes. A fixed brush is mounted to the shaft opposite to that of the support arms and can be used to clean the ankles and the top. bottom, and sides of the feet, and is capable of washing the area above the ankle if required.

A further object of the present invention is to provide an apparatus of this character that is made of plastic or other suitable material of sufficient strength to support the body as a cane might, while the user is standing essentially on one foot to effect the necessary cleaning of any portion of the lower extremities.

Still another object of the invention is to provide an apparatus of this character having substantially no moving parts which makes it easy to use, service and maintain.

It is still a further object of the invention to provide an apparatus of this character that is relatively inexpensive to manufacture and is simple but rugged in construction.

It may thus be seen that the objects of the present invention set forth herein, as well as those made apparent from the foregoing description, are efficiently attained. While the preferred embodiments of the invention have been set forth for purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

BRIEF DESCRIPTION OF THE DRAWING

Novel features and advantages of the present invention in addition to those mentioned above will become apparent to those skilled in the art from reading the following detailed description in conjunction with the accompanying drawings wherein.

DESCRIPTION OF THE PREFERRED EMBODIMENTS

Figures 1, 2, 3, 4:
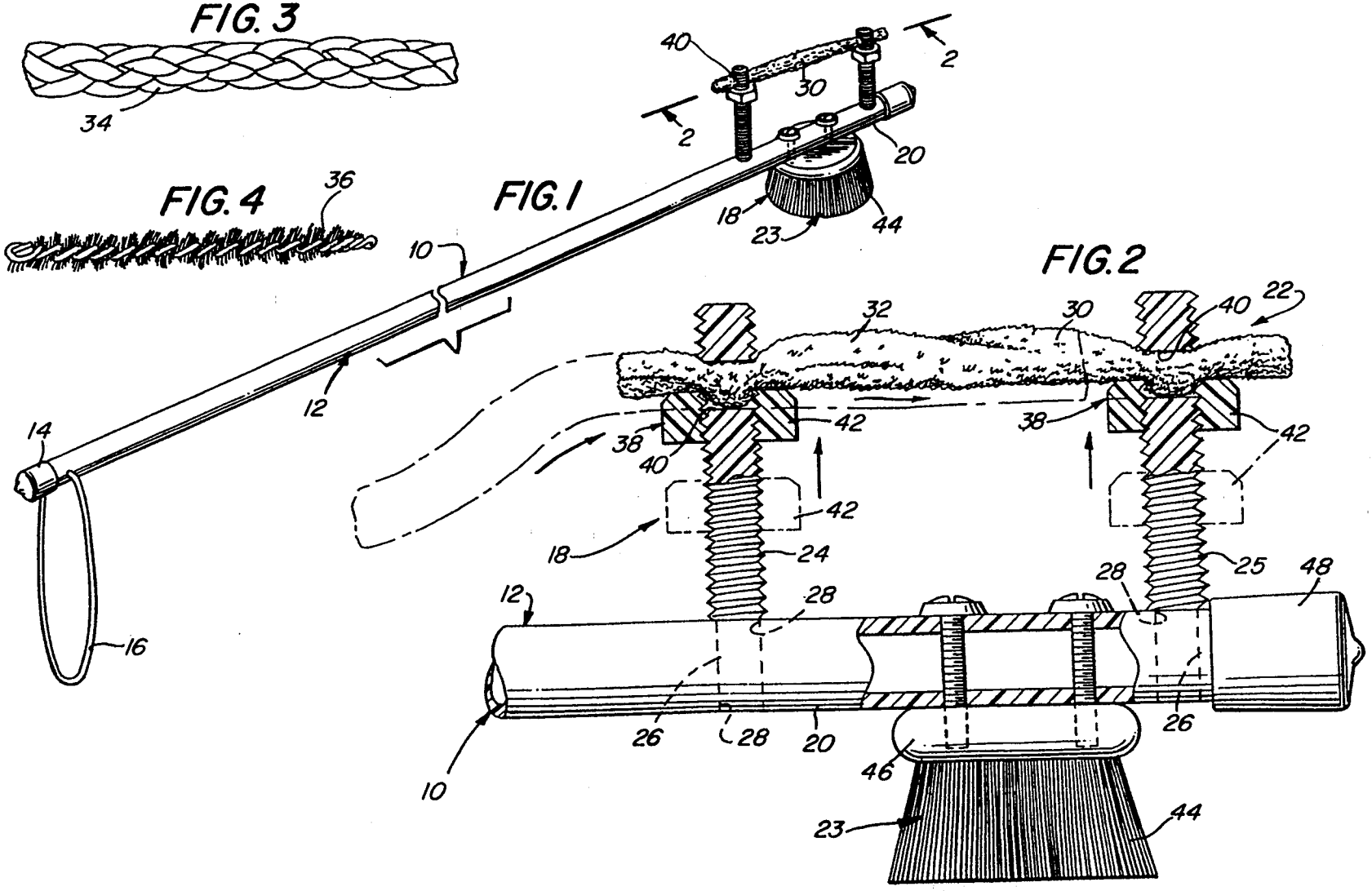
FIG. 1 is a perspective view of the present invention showing a foot-cleaning apparatus.
FIG. 2 is an enlarged side-elevational view taken substantially along line 2—2 of FIG. 1, wherein a toe-cleaning device is shown having a pair of spaced-apart, threaded, support arms with their upper ends shown in cross-section and a toe cleaning element securely mounted therebetween with a brush extending outwardly and rearwardly of the cleaning element.
FIG. 3 is an enlarged side-elevational view of a rope-like cleaning element.
FIG. 4 is still another enlarged side-elevational view of a cleaning element defined by an elongated twisted brush.

Referring more particularly to FIGS. 1 and 2, there is shown a first embodiment of the present invention which defines a foot-cleaning apparatus, generally indicated at 10, which provides a means by which an individual can safely clean or scrub his or her feet without the need of bending over or risk of falling in a confined area, such as a stall shower or bathtub as heretofore mentioned.

The foot-cleaning apparatus 10 comprises an elongated shaft or tubing 12 formed from a suitable stiff material, preferably plastic and having an approximate length of between 32 to 34 inches, the upper end 13 being closed by a suitable cap member 14. A hanging cord 16 is attached adjacent the upper end, whereby the foot-cleaning apparatus 10 can be readily hung when not in use or be placed about the user's wrist to keep the shaft from dropping when in use.

A cleaning assembly, indicated generally at 18, is provided adjacent the lower end 20 of the shaft and includes a means, generally designated at 22, for cleaning between the toes and also a brush 23. Toe-cleaning means 22 comprises a pair of threaded support arm members 24 and 25 that are fixedly secured to the body of the shaft, as illustrated in FIG. 2. The support arm members are formed with an extended pin member 26 that is fixedly secured within aligned holes 28 provided in the lower end 20 by suitable means such as a plastic adhesive. Support arm members 24 and 25 are spaced apart by approximately 4 inches, a cleaning element 30 being adapted to be releasably mounted adjacent the upper free end of each support arm which allows the cleaning element 30 to be readily positioned by the user between two toes. The cleaning element 30 comprises any suitable material such as terry cloth, illustrated in FIG. 2 as an elongated wash cloth 32 which is interchangeable with other cleaning elements such as illustrated in FIGS. 3 and 4. In FIG. 3 a strand of woven cotton rope 34 is shown. Other types of ropes are contemplated including the use of a plastic rope or a bundle of lengths of yarn. In FIG. 4 an elongated brush 36 similar to that of a bottle brush may also be used if desired.

Accordingly, each support arm 24 and 25 includes a releasable mounting means, indicated generally at 38, comprising an elongated slot 40 positioned within each arm just below the distal end thereof and a nut 42 that is threadably mounted on each support arm 24 and 25. When a cleaning element 30 is to be mounted to the arm members, the nuts 42 are lowered along the respective threaded portion of each arm member 24 and 25 to expose the full length of the oppositely disposed slots 40. A selected cleaning element is then positioned in the aligned slots, as seen in FIG. 2, at which time the respective nuts 42 are rotated upwardly to tightly engage the cleaning element 30 adjacent its opposite ends. Thus, it can be seen that various types of cleaning elements may be employed since the skin between the toes is very sensitive in most people and, thus, one can select a suitable cleaning element that is the most comfortable.

Brush 23 can be used as desired but it is readily adaptable for scrubbing the bottom and sides of the foot and ankle as well as the area above the ankle when required. Brush 23 can be formed in any suitable configuration but is shown herein as a circular brush having elongated bristles 44 mounted to a brush base member 46 which is attached to the side of the shaft opposite from that of the cleaning element 30 and positioned intermediate the two support arms 24 and 25. Any suitable attaching means may be employed but is illustrated as a pair of screws 48 mounted through shaft or tubing 12.

A skid-resistant cap member 48 defining a foot member is attached to the lower end of the shaft 12 so as to prevent the apparatus from slipping on a wet and soapy surface. When the foot-cleaning apparatus 10 is used, one stands substantially on one foot to allow free movement of the other foot so it can be easily cleaned as needed. Shaft 12 will have sufficient strength to provide support for the user as that of a typical cane.

Figure 5:
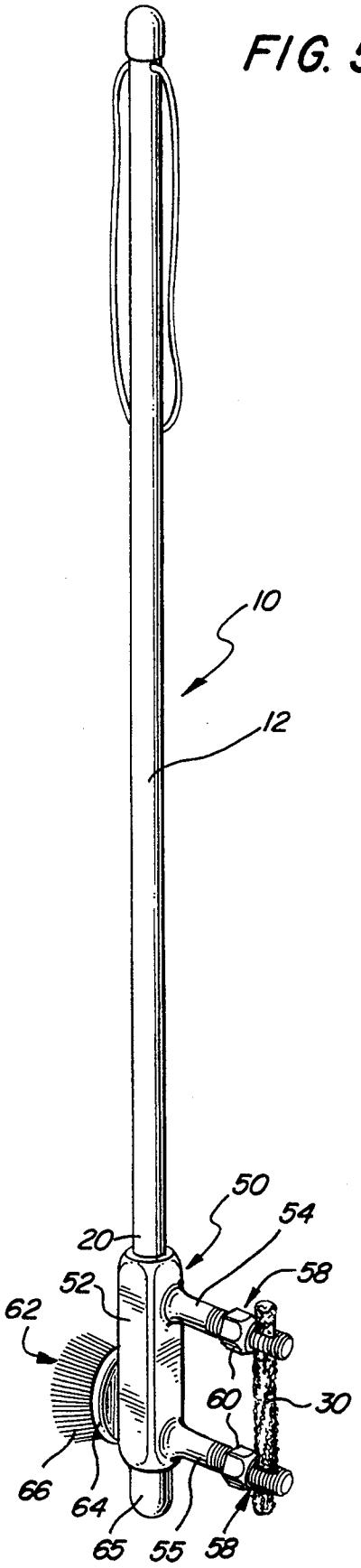
FIG. 5 is a side-elevational view of a second embodiment of the present invention.
Figure 6:
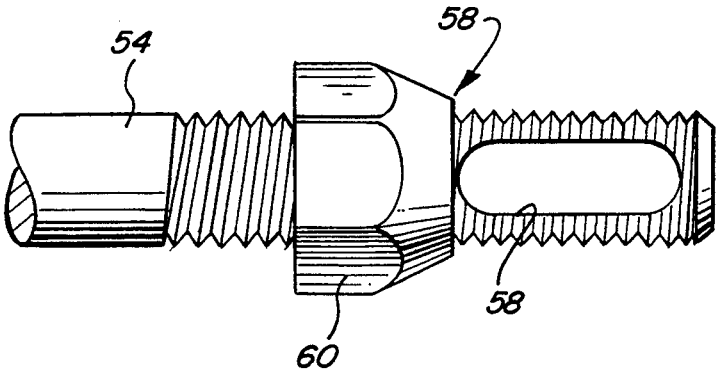
FIG. 6 is an enlarged view of the threaded end of a support arm.

Referring now to the embodiment of FIGS. 5 and 6, there is shown and alternative arrangement of the foot-cleaning apparatus 10, wherein a cleaning assembly, indicated generally at 50, is fixedly mounted to the lower end 20 of shaft 12, the cleaning assembly being defined as an enlarged body 52. Integrally formed as part of body 52 is a pair of equally spaced support arm members 54 and 55 which extend outwardly from body 52, having an approximate length of 2 inches, and are spaced apart from each other by approximately 4 inches.

Support arms 54 and 55 form part of a releasable mounting means, indicated generally at 58, provided as an integral part of the cleaning assembly 50, wherein the two aligned support arms 54 and 55 include elongated slots 58 that are positioned within each support arm just below the distal end thereof. The outer free end portions of the support arms are threaded to operably receive respective nuts 60. Various cleaning elements 30 as described above are adapted to be removably mounted in slots 58 and secured in place by nuts 60.

A brush 62 is integrally formed as part of body 52 by means of a base member 64 in which bristles 66 are mounted. The bristles 64 extend outwardly from the base member 64 in a direction generally perpendicular to the axis of the elongated shaft 12 as illustrated. Base member 64 of brush 62 is positioned on the opposite side of body 52 from that of support arms 54 and 55 and cleaning element 30. The free end of body 52 is formed having a skid-resistant cap or plug 65 member, defining a foot member that allows the apparatus 10 to be employed similar to a cane for support to permit the user to stand safely on one leg without falling.

The foregoing should only be considered as illustrative of the principles of the invention. Further, since numerous modifications and changes may readily occur to those skilled in the art, it is not desired to limit the invention to the exact construction and operation as shown and described in the present disclosure of the two embodiments, and accordingly, all suitable modifications and equivalents may be resorted to, falling within the scope of the claimed invention.

What is claimed:

1. A foot-and-toe cleaning apparatus comprising:

an elongated shaft formed from a stiff material;

a cleaning assembly fixedly mounted adjacent the lower end of said shaft, wherein said cleaning assembly includes:

means for cleaning between the toes;

a brush mounted on said shaft and positioned diametrically opposite that of said toe-cleaning means for cleaning the foot area including the ankle and lower portion of the user's legs;

the toe-cleaning means comprising;

a pair of support arm members which extend outwardly from said shaft and are fixedly mounted thereto in an aligned spaced-apart position relative to each other;

a toe-cleaning element having oppositely disposed free ends arranged to be removably mounted to said spaced-apart support arm members; and means for removably securing said cleaning element to each of said spaced-apart support arm members.

2. A foot-and-toe cleaning apparatus as recited in claim 1, wherein said toe-cleaning means comprises;

a pair of support arm members which extend outwardly from said shaft and are fixedly mounted thereto in an aligned spaced-apart position relative to each other;

a toe-cleaning element having oppositely disposed free ends arranged to be removably mounted to said spaced-apart support arm members; and means for removably securing said cleaning element to each of said spaced-apart support arm members.

3. A foot-and-toe cleaning apparatus as recited in claim 2, wherein said removable securing means comprises an elongated slot member formed in the adjacent outer free end of each of said spaced-apart support arm member, and wherein said support arm members are threaded to receive a threaded nut thereon, whereby the nut is adjustable relative to said elongated slot to engage the respective free ends of said toe-cleaning element which are positioned within each oppositely disposed respective slot.

4. A foot-and-toe cleaning apparatus as recited in claim 3, wherein said brush is formed with a base member and outwardly extended bristles, and wherein said base is removably mounted to said shaft mounting means.

5. A foot-and-toe cleaning apparatus as recited in claim 4, wherein said shaft has an upper capped end adjacent to which is attached a hanging cord, and wherein a nonskid member is mounted to the distal end of said shaft.

6. A foot-and-toe cleaning apparatus comprising:

an elongated shaft formed of a stiff material and having an upper and a lower end;

a cleaning assembly fixedly mounted adjacent the lower end of the shaft, the cleaning assembly including:

an enlarged body member mounted on the lower end of the shaft;

a brush mounted on said body member for cleaning foot area including the ankle and lower portion of the user's legs;

a pair of spaced-apart support arms extending outwardly from said body member opposite the brush, the arms being integrally formed on the body member in an aligned spaced-apart position relative to each other;

a toe-cleaning element having oppositely disposed free ends arranged to be removably mounted to said spaced-apart support arms; and means for removably securing said cleaning element to each of said spaced-apart support arms.

7. A foot-and-toe cleaning apparatus as recited in claim 6, wherein said removable securing means comprises an elongated slot member formed in the adjacent outer free end of each of said spaced-apart support arms, and wherein said support arms are threaded to receive a threaded nut thereon, whereby the nut is adjustable relative to the elongated slot to engage the respective free ends of said toe-cleaning element which are positioned within each oppositely disposed respective slot.

8. A foot-and-toe cleaning apparatus as recited in claim 7, wherein said brush is formed with a base member and outwardly extended bristles, and wherein said base is integrally mounted to said body member.

9. A foot-and-toe cleaning apparatus as recited in claim 8, wherein said cleaning element is an elongated strip of terry cloth material.

10. A foot-and-toe cleaning apparatus as recited in claim 8, wherein said cleaning element is an elongated woven cotton rope.

11. A foot-and-toe cleaning apparatus comprising:

an elongated shaft formed from a stiff material and having an upper end, a lower end and a longitudinal axis;

a cleaning assembly fixedly mounted adjacent the lower end of said shaft, the cleaning assembly including:

a means for cleaning between the toes mounted on the lower end of the shaft;

a brush mounted on the lower end of the shaft and positioned diametrically opposite that of the toe-cleaning means for cleaning the foot area, the brush having a base with bristles extending outwardly from the shaft in a direction generally perpendicular to the axis of the elongated shaft to facilitate the scrubbing of the sides of the user's feet and ankles; and a skid-resistant cap member attached to the distal end of the shaft to inhibit said distal end from slipping on a wet and soapy surface when the shaft is used as a support for the user.

12. A foot-and-toe cleaning apparatus as recited in claim 11, wherein said toe-cleaning means comprises:

a pair of support arm members which extend outwardly from said shaft and are fixedly mounted thereto in an aligned spaced-apart position relative to each other;

a toe-cleaning element having oppositely disposed free ends arranged to be removably mounted to said spaced-apart support arm members; and means for removably securing said cleaning element to each of said spaced-apart support arm members.

* * * * *